United States Patent [19]

Hudson, Jr.

[11] Patent Number: 4,751,904

[45] Date of Patent: Jun. 21, 1988

[54] LOW PROFILE FUEL INJECTION RAIL

[75] Inventor: Sharon J. Hudson, Jr., Lambertville, Mich.

[73] Assignee: Sharon Manufacturing Company, Lambertville, Mich.

[21] Appl. No.: 63,396

[22] Filed: Jun. 18, 1987

Related U.S. Application Data

[63] Continuation-in-part of Ser. No. 928,046, Nov. 7, 1986.

[51] Int. Cl.[4] ..... F02M 61/14

[52] U.S. Cl. ..... 123/470; 123/447; 239/550

[58] Field of Search ..... 123/468, 469, 470, 472, 123/467, 463, 447; 239/550, 600

[56] References Cited

U.S. PATENT DOCUMENTS

| | | | |
|---|---|---|---|
| 2,166,331 | 7/1939 | Waeber | 123/470 |
| 3,125,078 | 3/1964 | Reiners | 123/468 |
| 4,457,280 | 7/1984 | Hudson, Jr. | 123/470 |
| 4,474,160 | 10/1984 | Gartner | 123/470 |
| 4,519,368 | 5/1985 | Hudson, Jr. | 123/468 |
| 4,586,477 | 5/1986 | Field et al. | 123/468 |
| 4,601,275 | 7/1986 | Weinland | 123/468 |
| 4,649,884 | 3/1987 | Tuckey | 123/510 X |

*Primary Examiner*—Ira S. Lazarus
*Assistant Examiner*—Richard Cole
*Attorney, Agent, or Firm*—Harold F. Mensing

[57] ABSTRACT

A low profile fuel injection rail assembly for supplying fuel to a plurality of electromagnetic fuel injectors on an internal combustion engine. The fuel rail assembly is characterized by a plurality of fuel sump chambers defined by linearly spaced apart nodular rail sections which are connected in series by a plurality of tubular rail sections having cross sectional openings of reduced size. Each sump chamber surrounds an injector socket recessed into the bottom of the rail or an injector receptacle recessed into the top of the rail. Fuel is supplied to the injectors through inlets in the sockets or receptacles. Fuel supply and return fitments are mounted at one end of the rail along with means for connecting a fuel pressure regulator having two coaxial fuel passageways.

14 Claims, 8 Drawing Sheets

LOW PROFILE FUEL INJECTION RAIL

CROSS REFERENCE TO RELATED APPLICATION

The present application is a continuation-in-part of U.S. patent application Ser. No. 06/928,046, pending filed Nov. 7, 1986.

BACKGROUND OF THE INVENTION

FIELD OF THE INVENTION

This invention relates to a tubular fuel rail for supplying fuel to a plurality of electromagnetic fuel injectors for a multicylinder internal combustion engine. More specifically it relates to a fuel rail having a plurality of spaced apart bulbous or nodular sections defining fuel sumps which surround recessed sockets for containing end portions of the injectors and supplying fuel thereto.

Prior art fuel rails may have functioned acceptably but many were made up of a large number of separate parts. The large number of parts resulted in unnecessary manufacturing costs and difficulties, particularly in placing the parts in their relative positions and integrally connecting and sealing the parts together. Some of the early fuel rails were bulky and interferred with access to the injectors or to adjacent parts. Occasionally audible noise would develop as a result of a resonant interaction caused by the timed movement of fuel into the injectors. Another problem which may be related to resonance was that injector outputs varied depending upon the location of the injector. Apparently turbulence or some other unexplained internal factor affected the distribution of fuel to the separate injector sites and caused this lack of uniformity. In some prior art fuel rails the fuel inlets to the sockets were located at the lowest level of the fuel rail and thus water and dirt contaminents in the fuel could easily gravitate directly into the fuel inlets and be inducted into the injectors. In addition most of the prior art fuel rails supplied fuel to the tops of the injectors. This condition required the fuel rails to be positioned over the tops of the injectors and thus be mounted a substantial distance away from the engine's intake manifold. Such positioning was less than ideal. For one thing it required the use of strong fuel rails and strong supporting brackets in order to withstand the constant vibration and other large moments of force incident with the operation of a motor vehicle. Another problem with such fuel delivery systems was that they occupied too much space. Furthermore, if one of the injectors failed in use, the entire fuel rail had to be removed in order to gain access to the faulty injector.

Accordingly it is a general object of this invention to solve the aforementioned problems and to do so with a fuel rail assembly that effectively supplies fuel to the injectors, is also compact, durable, economical and easy to manufacture utilizing high production output machinery. The invention disclosed herein solves a number of these problems by forming the injector sockets directly in the top or bottom half of the fuel rail. The sockets are recessed into the rail rather than projecting below or above it. This allows for a reduction in the height of the rail. The bulbous sump chamber sections appear to dampen or attenuate noise impulses produced by the pulsed flow of fuel into the injectors. The combination of bulbous sump sections connected by narrow tubular arteries appears to prevent resonant noise buildup from one sump to another. This combination also provides a marked improvement to injector output uniformity. Fuel is fed into the injector sockets through inlets located above the bottom of the sump chambers so that fuel contaminants which may enter the rail cannot gravitate into the socket inlets.

SUMMARY OF THE INVENTION

The improved fuel injection rail assembly of this invention is a low profile type wherein sockets or receptacles for holding respectively top or bottom ends of the fuel injectors are each recessed into the body of the rail. To accomodate the recessed sockets and to provide fuel sump chambers which surround them the portion of the rail adjoining each socket is enlarged. The bulbous or nodular sections defining the fuel sump chambers are connected in series by relatively narrow fuel arteries or tubular sections. In a preferred embodiment the fuel rail is comprised of an elongated bottom or base member with upturned sides and a mating cover member with downturned sides. The sides of one member overlap the sides of the other to provide a peripheral seam which is made fluid tight by bonding the overlapping sides together. Connector fitments for fuel supply and return lines are positioned at one end of the rail. In one embodiment a diverter member separates the rail interior into a upper fuel run and a lower fuel run with fuel being supplied to an end of the lower run and returned from an adjacent end of the upper run. A bracket for mounting a fuel pressure regualtor having either juxtaposed or coaxial countercurrent flow fuel passageways is integrally attached to the rail. In the embodiment designed for use with the coaxial passageway regulator, the regulator mounting bracket is located at the same end as the connector fitments and is in a closely coupled arrangement therewith. Fuel is supplied to the respective ends of the injectors from the interior of the rail through inlets in the sockets or receptacles at locations above the bottoms of the surrounding sump chambers. Fuel crossover fitments are provided along with other mounting brackets and supports whereever they are appropriate.

The details and advantages of the invention will be understood best if the written description is read with reference to the accompanying drawings.

BRIEF DESCRIPTION OF THE DRAWINGS

FIG. 20 is a cross sectional view taken along lines 20—20 of FIG. 16.

DESCRIPTION OF THE PREFERRED EMBODIMENTS

Figures 1, 3, 4:
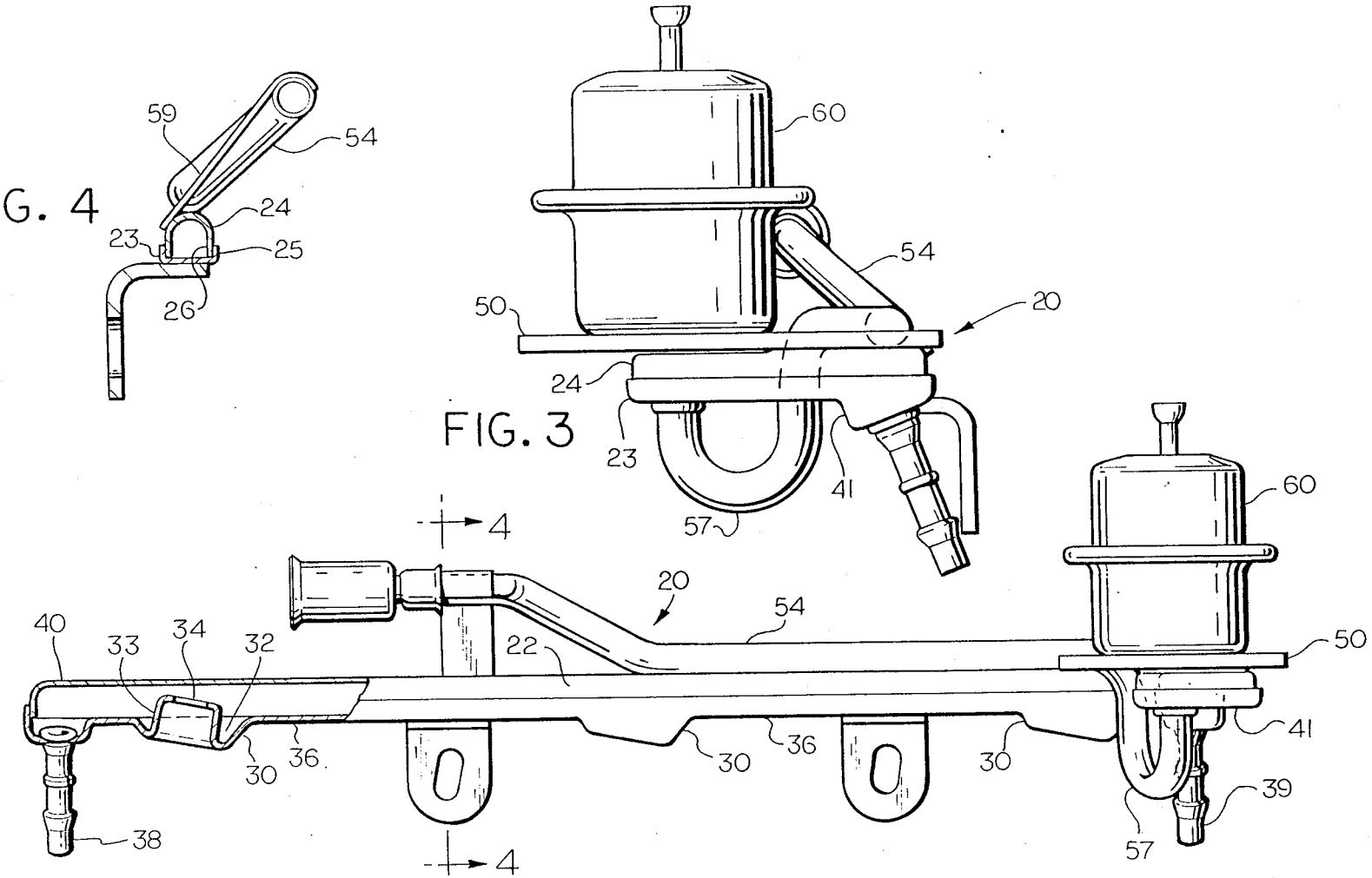
FIG. 1 is an outer side view of one of a pair of fuel rail assemblies for a V-6 engine with a portion of the assembly broken away to show the interior of one end and with a pressure regulator mounted on the other end.
FIG. 3 is an end view of FIG. 1.
FIG. 4 is a cross sectional view taken along lines 4—4 of FIG. 1.
Figure 5:
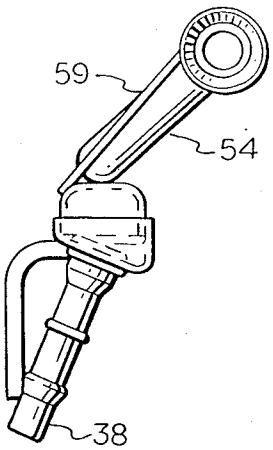
FIG. 5 is an end view opposite that of FIG. 3.
Figure 6:
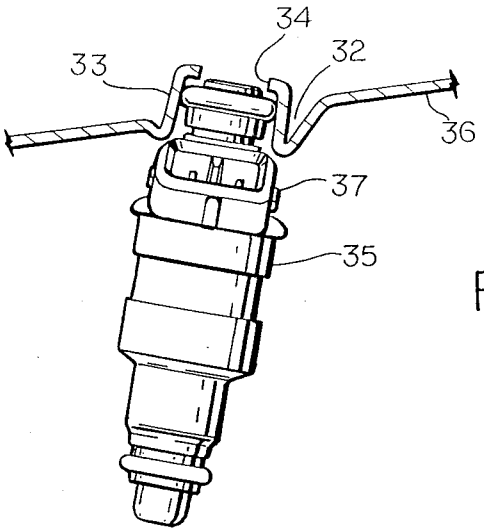
FIG. 6 is an enlarged sectional view of a broken away portion of a nodular section showing a fuel injector inserted in a socket.

Referring to the drawings it will be noted that two fuel injection rail assembly embodiments, adapted for use on V-6 engines, are illustrated in FIGS. 1–15. Each embodiment includes a pair of fuel injection rail assemblies, one for each bank of cylinders. Many of the elements are similar in structure or function so for the sake of brevity and for ease of understanding one fuel rail assembly of the first pair shown will be described in detail along with its component parts, while the remaining fuel rail assemblies and their component parts will be described in detail only in so far as they differ. Wherever possible similar components will be given similar reference numerals. It is to be understood that the teachings disclosed herein are not limited to fuel injection systems for V-6 engines but can be adapted to engines having more or fewer cylinders including engines wherein the cylinders are arranged in single row, such as the fuel rail embodiment shown in FIGS. 16–20 for a four cylinder in line engine.

The fuel injection rail assembly 20 illustrated in FIGS. 1–6 has a tubular fuel rail beam 22 comprised of an elongated base member 23 and a matching cover member 24. Preferably the members are formed from sheet metal by stamping processes. The base member 23 has an upturned peripheral wall 25 which overlaps a corresponding downturned peripheral wall 26 of the cover member 24. This overlapping relationship could be reversed so that the peripheral wall 26 is on the outside and thus provides a downwardly facing edge on the outside rather than an upwardly facing one. The downwardly facing edge is less likely to trap road dust. In either case the overlapping walls 25, 26 are bonded together, such as by furnace brazing to form a liquid tight seam extending around the longitudinal perimeter of the fuel rail beam 22.

The fuel rail beam 22 has a plurality of spaced apart bulbous or nodular sections 30 each of which defines a fuel sump chamber 32. The bottom or belly portion of each sump chamber 32 is formed in the base member 23. Preferably it extends below the adjacent rail beam surfaces and its sidewall converges downwardly to the open end of an injector cup socket 33 where the sump sidewall merges with the injector cup sidewall. The tapered outer wall provides for close coupling between a fuel injector 35 and the rail yet allows easy access to an electrical connector 37 of the fuel injector normally found near its top. The injector cup socket 33 has a cylindrical body with a radiused edge on its open bottom end and a fuel supply outlet aperture 34 in the center of its otherwise closed top end (see FIG. 6). The aperture 34 has a diameter slightly larger than the diameter of the circular top portion of the injector located above the O-ring seal. The cylindrical axes of the injector sockets 33 may be canted towards one end of the rail beam 22 and lie in a plane passing vertically through the longitudinal axis of the rail beam.

The nodular sections 30 of the rail beam are connected in series by narrow fuel arteries or tube sections 36. The portions of cover member 26 which define the upper halves of the tube sections have inverted U-shaped cross sections as can be seen best in FIG. 4. The mating base member portions have planar bottoms with upturned parallel sides. Preferably the bottoms of the tube sections 36 are located at a level that is above the bottom of the sump chambers 32 but below the tops of the injector sockets 33.

Various fitments are incorporated in the ends of the fuel rails to provide a flow of fuel into and out of them. For example, the fuel rail assembly 20 in FIGS. 1–6, for one bank of three cylinders of a V-6 engine, is designed to be coupled to the fuel rail assembly 120 (FIGS. 7–10), for the opposite bank of cylinders by means of elastomeric crossover hoses (not shown). Accordingly crossover hose connectors 38, 39, 138, 139 are provided at the respective ends of fuel rail assemblies 20 and 120. These connectors are located in stub end sections 40, 41, 140, 141 which extend outwardly from the first and last nodular sections 30, 130 of fuel rail beams 22, 122. The cross sectional size of the stub sections is intermediate that of the tube sections 36, 136 and nodular section 30, 130. Each of the connectors is mounted in an aperture in a small flat surface found in the bottom panel of base member 23, 123. The flat surface is canted so that the longitudinal axis of the connector is tilted towards the opposite rail assembly (see FIGS. 3, 5, 9, 10).

Figure 2:
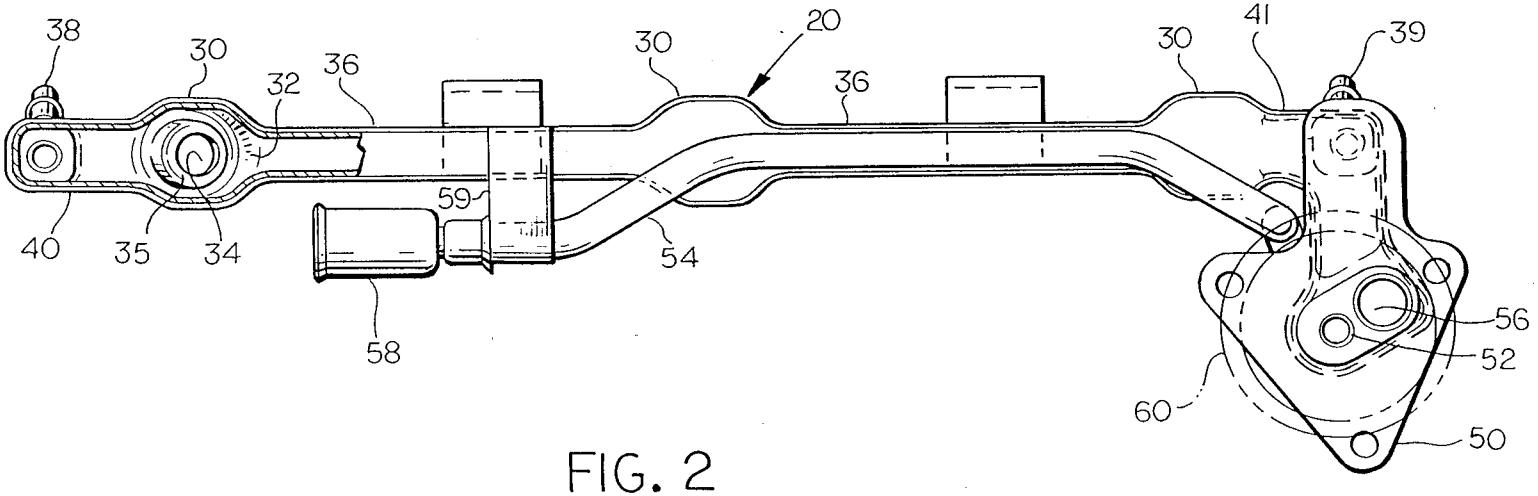
FIG. 2 is a plan view of FIG. 1 with the pressure regulator being illustrated in phantom lines to show details of its mounting plate.

One of the fuel rail assemblies of the pair has a pressure regulator mounting plate 50 affixed to the top of cover member 24 over its respective stub end section 41 (see FIGS. 1–3). Stub section 41 has a lateral leg with a small aperture 52 that contains the receiving end of a fuel return line 54 and a large aperture 56 in pressure communication with the fuel inside the rail 20. The fuel return line 54 extends downwardly from the pressure regulator mounting plate through the tubular stub section to a gooseneck section 57 whereupon it follows along the top of the rail beam to an offset and then terminates with a fuel line connector socket 58 adjacent to the end of the beam opposite from the regulator end. A supporting strap 59 extends downwardly at an angle from the end of the return line to the cover member where it is affixed. The pressure regulator 60 shown in full lines in FIGS. 1 and 3 and in phantom lines in FIG. 2 is a state of the art regulator.

Figure 9:
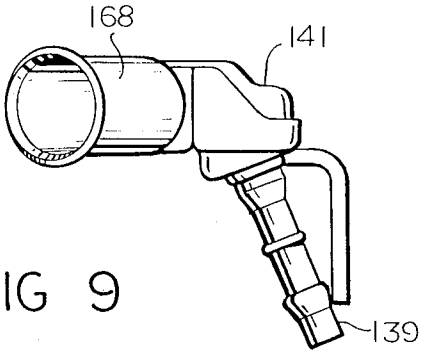
FIG. 9 is an end view of FIG. 7.
Figure 10:
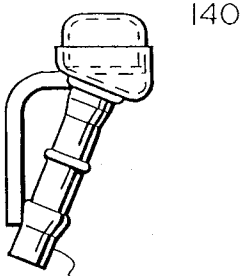
FIG. 10 is an end view opposite that of FIG. 9.
Figure 8:
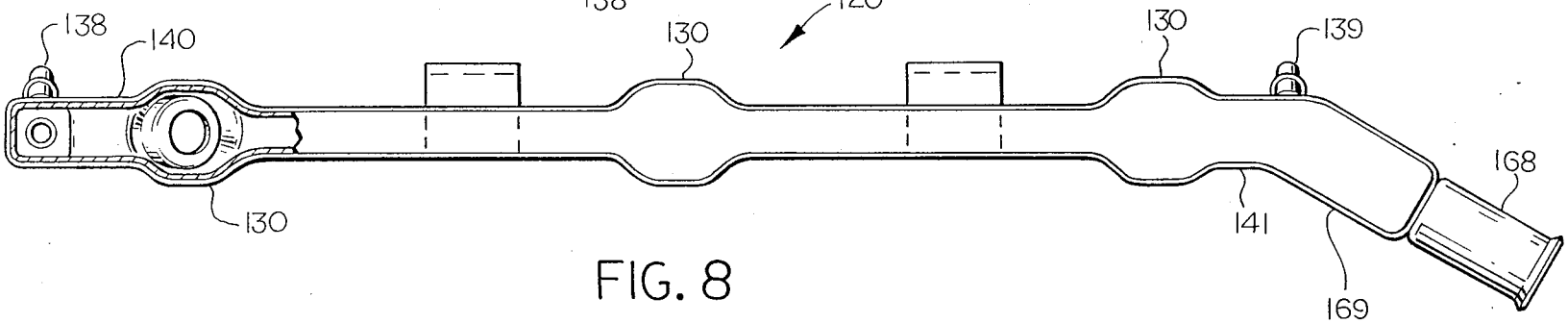
FIG. 8 is a plan view of FIG. 7.
Figure 7:
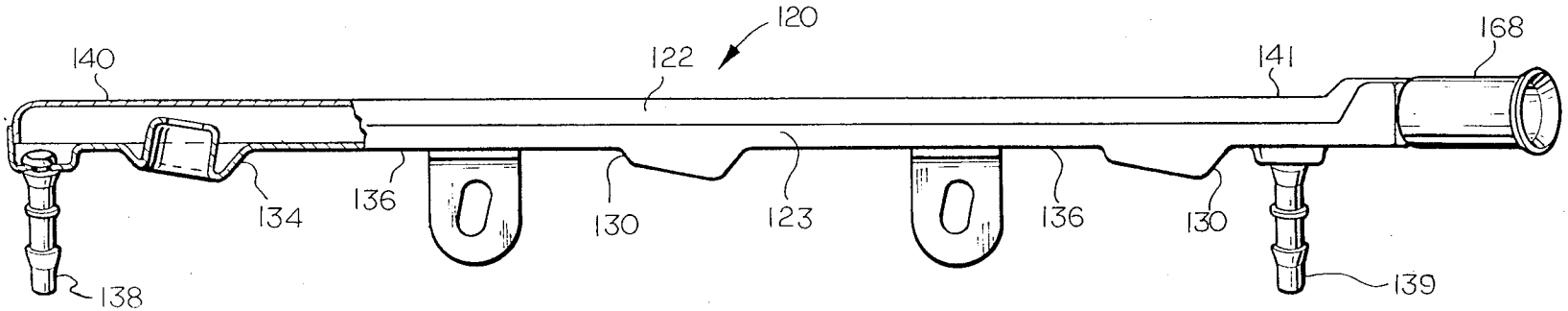
FIG. 7 is an outer side view of the other fuel rail assembly of the pair.
Figure 12:
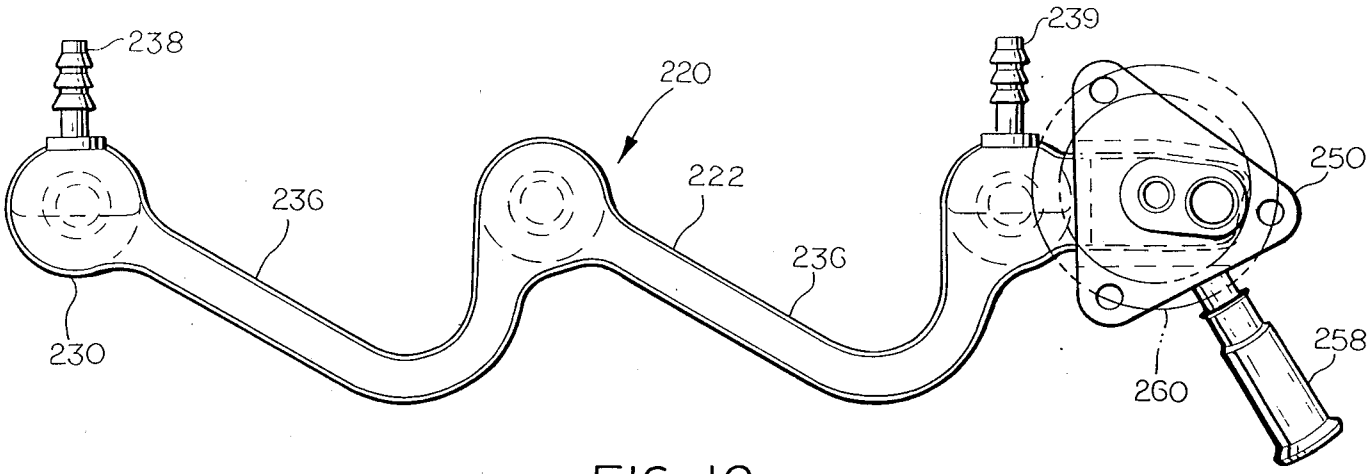
FIG. 12 is a plan view of FIG. 11.
Figure 11:
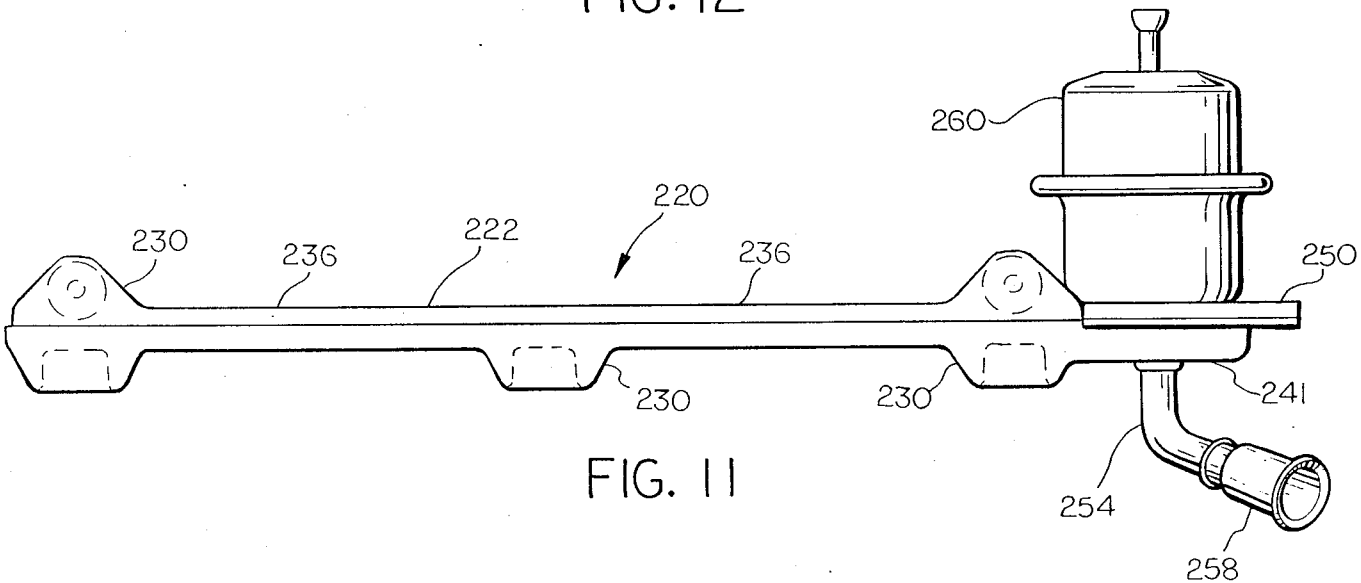
FIG. 11 is an outer side view of one of a pair of fuel rail assemblies of another V-6 engine embodiment.
Figure 14:
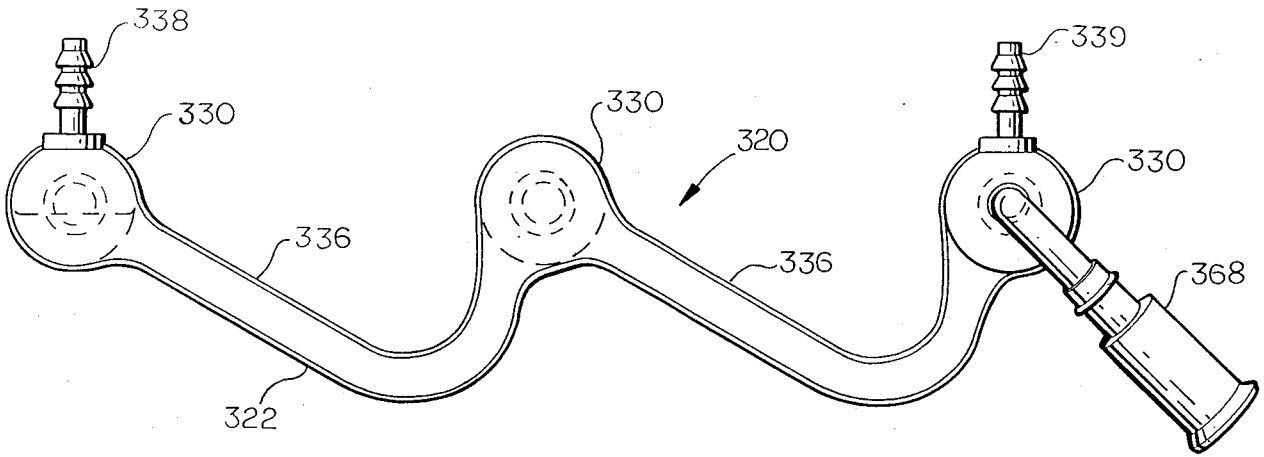
FIG. 14 is a plan view of FIG. 13.
Figure 13:
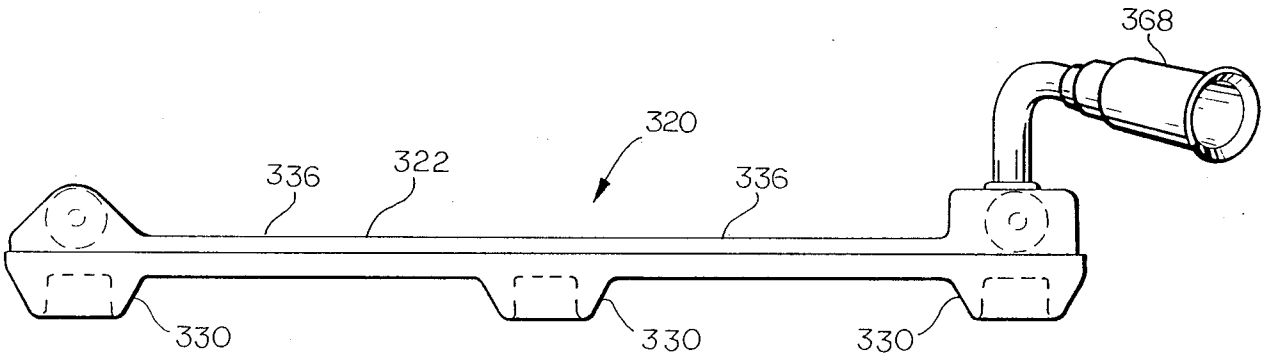
FIG. 13 is an outer side view of the other one of the pair of fuel rail assemblies.
Figure 15:
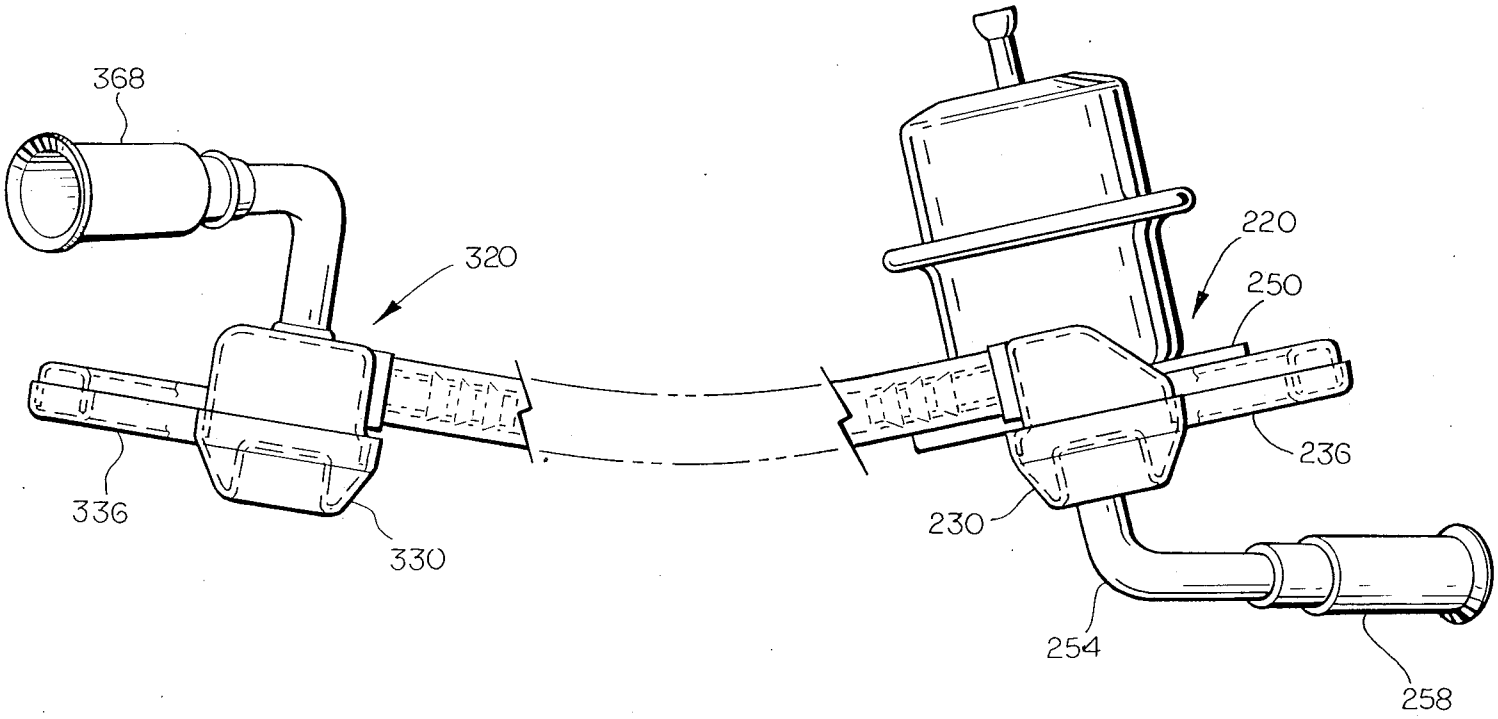
FIG. 15 is an end view of the pair of fuel rail assemblies connected together by crossover fuel hoses.
Figure 16:
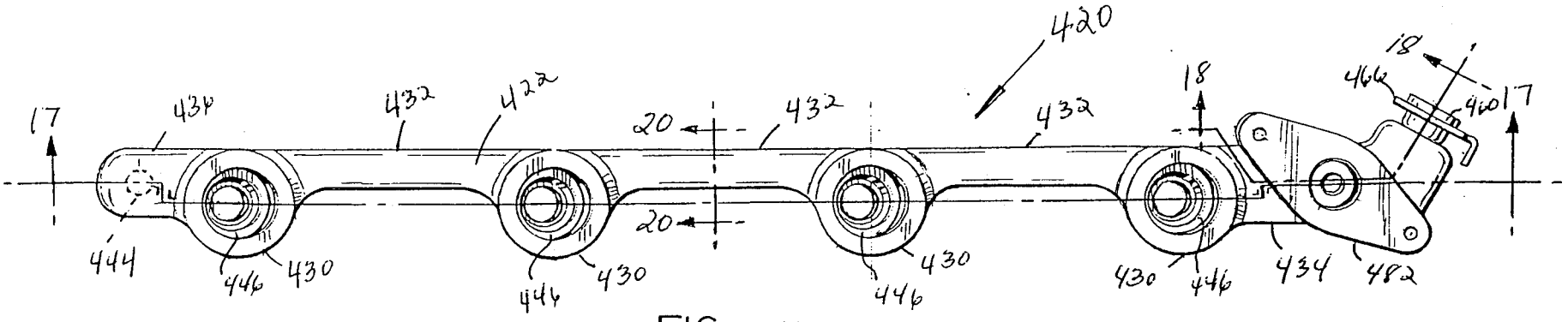
FIG. 16 is a plan view of a fuel injection rail assembly having injector receptacles into which injectors may be inserted from the top.
Figure 17:
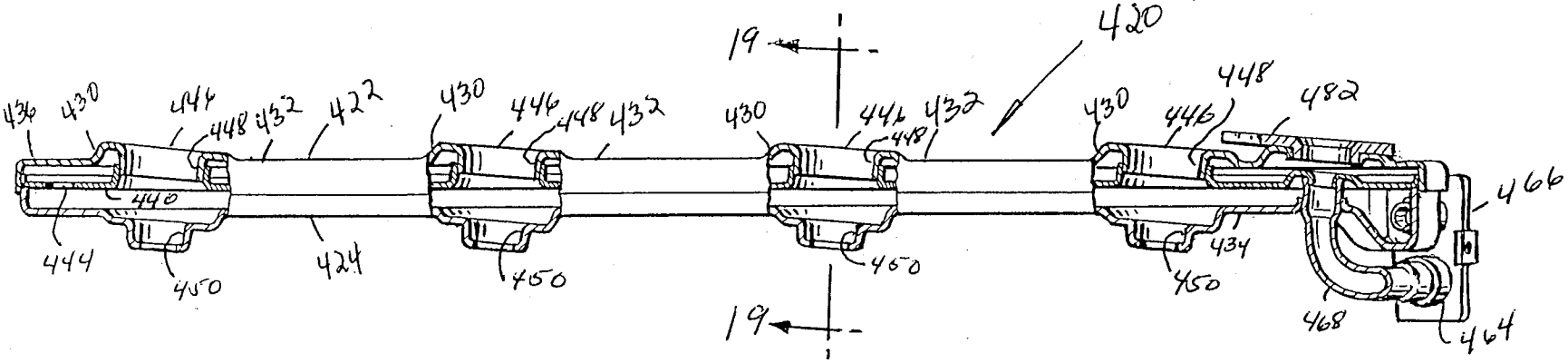
FIG. 17 is a sectional side view taken along lines 17—17 of FIG. 16.
Figure 18:
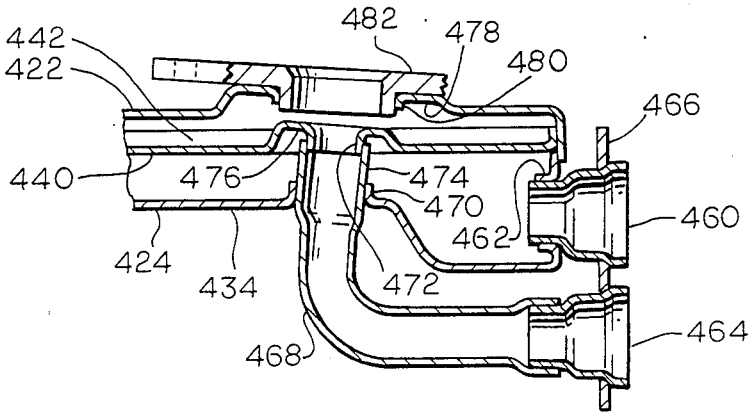
FIG. 18 is a cross sectional view taken along lines 18—18 of FIG. 16.
Figure 19:
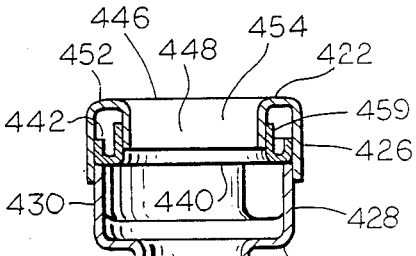
FIG. 19 is a cross sectional view taken along lines 19—19 of FIG. 17.

Fuel is supplied under pressure to the pair of fuel rail assemblies 20, 120 through a fuel line connector socket 168 affixed to the end of an angular leg 169 of stub end section 141 on rail 120 (see FIGS. 7–9). After flowing into fuel rail assembly 120 a portion of the fuel exits the assembly through crossover fuel line connectors 138, 139, and travels through parallel crossover hoses to the crossover fuel line connectors 38, 39 where it enters fuel rail assembly 20. Excess fuel is returned to the supply system via the pressure regulator and return line 54 on fuel rail assembly 20.

The embodiment illustrated in FIGS. 11–15 also has a pair of fuel rail assemblies 220, 320 designed for use in tandem on a V-6 engine. They too have tubular fuel rail beams 222, 322 with spaced apart nodular sections 230, 330 connected in series by narrow fuel arteries or tube sections 236, 336. However the nodular sections are generally circular, when viewed in the plan view, rather than oblong as in the previously described embodiment and the connecting tube sections are arcuate rather than straight. The crossover hose connectors 238, 239, 338, 339 are mounted in domed sections formed in the tops of the nodular sections. Only one of the fuel rail beams 222 has a stub section 241 extending outwardly from one of its end nodules. The mounting plate 250 for the regulator 260 is affixed to the top of this stub section 241. The fuel return line 254 is foreshortened and terminates with a connector socket 258 disposed below the end of the stub section 241 (see FIG. 11). The fuel supply line is connected to the domed top portion of a nodular section located at the end of fuel rail beam 322 remote from the pressure regulator end of the adjoining rail beam 222. A connector 368 is provided on the distal end of a short fuel supply line elbow.

The fuel flow pattern in this embodiment differs from the prior embodiment in that the fuel return line connector is located at the same end of its fuel rail beam as the pressure regulator rather than adjacent to its other end. In both embodiments the fuel pressure regulator and the fuel supply line connector are located at opposite ends of the paired fuel rail assemblies. The portion of the fuel return line which doubles back along its respective fuel rail beam towards the opposite end thereof in the first embodiment is eliminated from the second embodiment wherein the return line connector is closely coupled to a short elbow section of line below the pressure regulator.

Now referring to the embodiment shown in FIGS. 16–20 of the drawings the illustrated fuel rail assembly is denoted generally by reference numeral 420. The rail portion of the assembly is made of sheet metal parts produced by stamping processes and is comprised basically of an elongated top rail member 422 and a mating bottom rail member 424. Each of these members has a peripheral wall with the wall of one member overlapping the wall of the other. The peripheral wall 426 of member 422 is turned downwardly from its base panel and the peripheral wall 428 of member 424 is turned upwardly from its base panel. The overlapping walls are bonded together, such as by furnace brazing methods, to form a hollow fuel rail. Preferably the peripheral wall sections along one side of the rail are straight and the wall sections along the other side have a series of spaced apart lateral undulations. With this configuration the fuel rail has a plurality of nodular sections 430 connected in series by tubular sections 432 of reduced cross sectional area. Preferably the fuel rail also has end extensions 434, 436 projecting longitudinally beyond the first and last nodular sections.

An internal partition or diverter member 440 having the same outline as bottom member 424 and an upturned peripheral wall 442 to match, divides the interior of the fuel rail into top and bottom fuel runs. Communication between these runs is through an opening 444 in the diverter adjacent one end thereof.

Fuel injector receptacles 446 are located in the nodular sections 430. To provide additional height and volume for the receptacles 446, annular portions of the top member 422 are raised above the adjacent surfaces of the top member. The additional height is advantageous where, as here, the axes of the receptacles are canted, for example 4°, from a reference line running normal to the longitudinal axis of the rail. Each of the receptacles 446 has an upper seat section 448 spaced from a coaxially aligned lower seat section 450 by an annular fuel supply opening. The upper seat section 448 is defined by a flat annular shoulder 452 surrounding the receptacle entry opening and a cylindrical wall 454 extending downwardly from the inner edge of the annular shoulder 452. Preferably the cylindrical wall 454 is extruded from a portion of the sheet metal originally within the entry opening. The lower seat section 450 is defined by a similarly extruded cylindrical wall 456 projecting downwardly from the bottom rail member 424 and a narrow shoulder surrounding an outlet aperture 458 in the bottom of the cup shaped lower seat section 450. Cylindrical walls 459 extending upwardly from the diverter member 440 are concentrically aligned with the cylindrical walls 454 projecting downwardly from the top rail member 422 and are sealingly connected to the lower ends of walls 454 to isolate the top fuel run from the bottom fuel run in these areas. As can be seen in the drawings, there is a hiatus or annular opening between the bottom end of the upper seat section 448 and the top end of the lower seat section 450 in each receptacle 446. It is through this opening that fuel is supplied to the electromagnetic injectors (not shown) in the receptacles from the bottom fuel run.

Fuel line connector fitments are located in extension end 434 opposite from extension end 436 where the opening 444 in the diverter member 440 is located. The male end of a female fuel supply line fitment 460 is sealed in an aperture having an inwardly extruded annular collar 462 located in the end wall of an angularly offset end of extension 434. The female end of a return line connector fitment 464 is located directly beneath supply line fitment 460 where they are both supported by bracket 466. Fitment 464 has a tubular elbow section 468 which extends along the underside of the fuel rail extension 434 from the female end of the fitment to a point located between the angular end section of extension 434 and the adjoining nodular section 430 where it turns upwardly and passes through a collared aperture 470 in the bottom rail member 424 to a coaxially aligned collared aperture 472 in the diverter member 440. Preferably the portion of the elbow 468 which is inserted into the rail extension has an enlarged cylindrical end 474 which is sealed to the inside of the upwardly extending extruded annular collar 470 and sealed to the outside of the downwardly extending annular collar 47 (see FIG. 19). End 474 and coaxially aligned collars 470, 472 may be canted at the same angle as the receptacle axes, in which case a flat annular area 476 immediately adjacent to collar 472 may be raised above the surrounding surface of diverter member 440 and tilted 4°.

A similarly raised and tilted annular flat 478 is formed around a collared aperture 480 in the top rail member 422 to carry a fuel pressure regulator mounting plate 482 affixed thereto. Collared aperture 480 and raised annular flat 478 are of substantially larger dimensions than the coaxially aligned corresponding elements of diverter member 440. These features provide for the convenient hookup and mounting of a fuel pressure regulator (not shown) that has two coaxially aligned countercurrent flow fuel passageways, an outer annular one of which communicates with fuel in the top run of the rail and a central one of which is sealingly connected to the inner end of the fuel return line.

Although the invention has been described with reference to the illustrated embodiments, it is to be understood that modifications could be made without departing from the scope of the invention as defined by the appended claims.

What is claimed is:

1. A fuel injection rail assembly comprising: an elongated top rail member, a mating bottom rail member bonded thereto to produce a hollow fuel rail, a diverter member disposed intermediate said top and bottom members, said diverter separating the interior of said rail into an upper fuel run and a lower fuel run, a plurality of fuel injector receptacles spaced along said rail, said receptacles each having top and bottom seats, each of said top seats having a circular entry opening extending through the top rail member with a cylindrical collar depending therefrom into said upper fuel run, each of said bottom seats being in the form of a cup with a cylindrical side wall projecting downwardly from said bottom rail member, and an aperture in the bottom of said cup, said top and bottom seats being coaxially aligned with one another and axially spaced apart by a fuel inlet opening to said receptacle.

2. A fuel injection rail assembly according to claim 10 wherein said cylindrical collars of said top member are interconnected in an overlapping relationship with upwardly extending mating annular wall sections formed on said diverter.

3. A fuel injection rail assembly according to claim 1 wherein said fuel rail has laterally spaced apart nodular sections connected in series by tubular sections of lesser cross sectional area and said receptacles are located in said nodular sections.

4. A fuel injection rail assembly according to claim 1 wherein said top and bottom members have peripheral walls, the peripheral wall of one member overlaps the peripheral wall of the other, and the sections of the peripheral walls along one side of the rail are straight from end to end, the sections of the peripheral walls along the other side have lateral undulations.

5. A fuel injection rail assembly according to claim 1 wherein said receptacles are isolated from direct communication with said upper run, surrounded by annular sections thereof and in direct fluid communication with said lower run.

6. A fuel injection rail assembly according to claim 1 wherein said rail has extensions at opposite at opposite ends thereof projecting outwardly beyond the end receptacles, said diverter extends into said extensions and has an aperture within one of said extensions to provide the sole means of fluid communications between said fuel runs.

7. A fuel injection rail assembly according to claim 6 wherein fuel supply and fuel return line fitments are mounted on the other extension in commuication with respective lower and upper fuel runs.

8. A fuel injection rail assembly according to claim 7 wherein said return line fitment is tubular and extends through said lower run to said upper run.

9. A fuel injection rail assembly according to claim 7 wherein a fuel pressure regulator mounting plate is affixed to said other extension, said plate has a central opening in fluid communication with said upper run, said opening being concentrically disposed with respect to an adjacent end of a tubular return line fitment which extends through said lower run to said upper run, the diameter of said central opening exceeds the internal diameter of said adjoining end of said tubular fitment.

10. A fuel injection rail assembly comprising: an elongated hollow fuel rail having a top and a bottom, a plurality of laterally spaced apart fuel injector receptacles disposed along said rail, a diverter member separating the interior of said rail into an upper fuel run and a lower fuel run, a fuel return line fitment having an end projecting into said rail from the bottom through said lower fuel run to a circular aperture in said diverter member, said aperture having a downwardly extending cylindrical collar which defines a lower seat for an insertable fuel pressure regulator and is disposed inside the adjacent end of said fitment, a fuel pressure regulator mounting plate integrally attached to the top of said rail, said plate having a larger diameter cylindrical upper regulator seat spaced above said lower regulator seat and coaxially aligned therewith such that the space between said seats is in direct fluid communication with said top fuel run.

11. A fuel injection rail assembly according to claim 10 wherein said rail has nodular sections connected in series by narrow artery sections and said receptacles are contained in said nodular sections.

12. A fuel injection rail assembly accoridng to claim 10 wherein each of said receptalcles is comprised of coaxially aligned axially spaced apart upper and lower cylindrical seat sections depending from circular receptacle apertures in the top and bottom of the rail respectively, and further include a receptacle fuel inlet opening in the space between said receptacle seat sections in direct fluid communication with said lower fuel run.

13. A fuel injection rail assembly according to claim 12 wherein said rail includes an elongated top member, a matimg bottom member bonded thereto, said diverter member has annular wall sections projecting upwardly from circular apertures therein, and said wall sections of said diverter member surround respective upper receptacle seat sections to which they are connected.

14. A fuel injection rail assembly according to claim 12 wherein said lower seat sections of said receptacles project below the surrounding bottom portions of the rail.

* * * * *